United States Patent [19]

Sugiyama

[11] 4,196,515

[45] Apr. 8, 1980

[54] CUTTER KNIFE

[75] Inventor: Makoto Sugiyama, Seki, Japan

[73] Assignee: Kai Cutlery Center Co., Ltd., Seki, Japan

[21] Appl. No.: 920,835

[22] Filed: Jun. 30, 1978

[51] Int. Cl.[2] ..... B26B 1/08

[52] U.S. Cl. ..... 30/162; 30/335

[58] Field of Search ..... 30/162, 320, 335, 336

[56] References Cited

U.S. PATENT DOCUMENTS

| | | | |
|---|---|---|---|
| 2,548,797 | 4/1951 | Ingwer | 30/162 |
| 4,005,525 | 2/1977 | Gringer | 30/335 X |
| 4,063,356 | 12/1977 | Hepworth | 30/335 X |
| 4,103,421 | 8/1978 | Quenot | 30/162 |

FOREIGN PATENT DOCUMENTS

| | | | |
|---|---|---|---|
| 2526386 | 6/1976 | Fed. Rep. of Germany | 30/320 |

*Primary Examiner*—Gary L. Smith

*Attorney, Agent, or Firm*—Norbert P. Holler; Philip Rodman

[57] ABSTRACT

A cutter knife having a sheath type holder, a control knob slidably mounted in the holder and a blade attached to and retained by the control knob. The holder is provided with an elongated slot along which the control knob is moved, a longitudinal through passage through which the blade is passed, a slide bore in which a blade-retaining portion of the control knob is slidingly moved and guiding means formed in the back side thereof. The guide means is in communication with the end portion of the slide bore, and are adapted to suitably guide the blade-retaining portion of the control knob. The blade can be moved through the through passage and fixed with a desired projection length from the holder, as the control knob is moved along the elongated slot and fixed to the latter by suitable means. As the front end of the control knob is brought into contact with the end of the elongated slot, the blade-retaining portion of the control knob is guided by the guiding means so as to be exposed from the back side of the holder, with a portion thereof left in the through passage, for free engagement and disengagement with and from the blade, thus affording an easy attaching and detaching, i.e. replacement of the blade.

10 Claims, 7 Drawing Figures

CUTTER KNIFE

BACKGROUND OF THE INVENTION

1. Field of the Invention

The present invention relates to an improvement in a cutter knife having a blade which is provided in the upper surface thereof with a plurality of weakening lines at which the blade can be cut so that, when the foremost blade section becomes dull, it can be cut off for putting the next blade section into use.

2. Description of the Prior Art

When a blade of a conventional cutter knife is replaced by a new one, a clip at the rear end portion of a sheath type holder is removed and a control knob is then slidingly moved to the rear end of the holder. Thus, a stopper for the control knob is removed therewith from the holder so that the blade is ready to be taken out.

When the blade is mounted in the holder, the former is inserted in the latter and the stopper is then fitted in a hole provided in the base portion of the blade. Then, the control knob is forwardly moved and the clip is attached to the rear portion of the holder so that the blade is fixed in the holder.

Thus, the removing and mounting of a blade of a conventional cutter knife is very troublesome.

SUMMARY OF THE INVENTION

An object of the present invention is to provide a cutter knife having a blade which can be easily and securely fastened to a control knob slidably fitted in a holder.

Another object of the present invention is to provide a cutter knife which permits an easy replacement of blade and which can be conveniently used.

To these ends, according to the invention, there is provided a cutter knife comprising: a sheath type holder having an elongated slot extending over the front and rear end portions thereof, a through passage, a slide bore and guiding means provided in the back side thereof and communicating the front end portion of the slide bore; a control knob adapted to be slidingly moved along the elongated slot and having retaining means adapted to slidingly move along the slide bore as the control knob is moved along the elongated slot, the retaining means having a projection; and a blade adapted to be moved through the through passage of said holder and adapted to be engaged and retained by said projection of the retaining means of the control knob; wherein the retaining means is brought into engagement with the front end of the slide bore, when the front end of the control knob is moved into contact with the edge of the elongated slot, and the retaining means is guided by the guiding means to come to be exposed from the back side of said holder, with at least a portion of the projection left in said slide bore, whereby the blade inserted through the through passage can be freely moved into and out of engagement with the retaining means of the control knob.

The above and other objects as well as advantageous features of the invention will become clear from the following description of the preferred embodiments taken in conjunction with the accompanying drawings.

DESCRIPTION OF THE PREFERRED EMBODIMENTS

Figure 1:
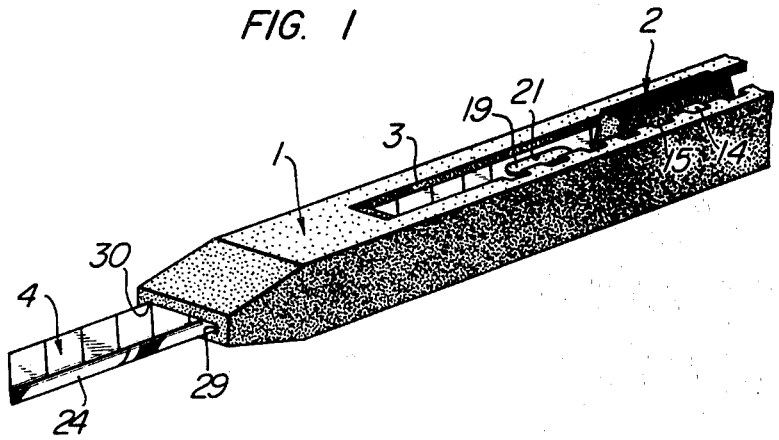
FIG. 1 is a perspective view of an embodiment of the present invention.
Figure 2:
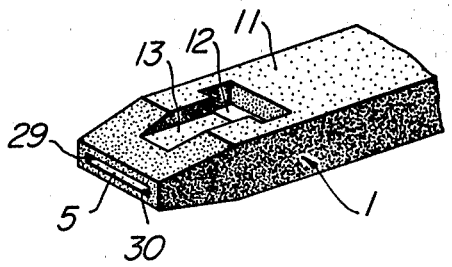
FIG. 2 is a bottom view in perspective of the front end portion of the sheath type holder in the embodiment as shown in FIG. 1.
Figure 3:
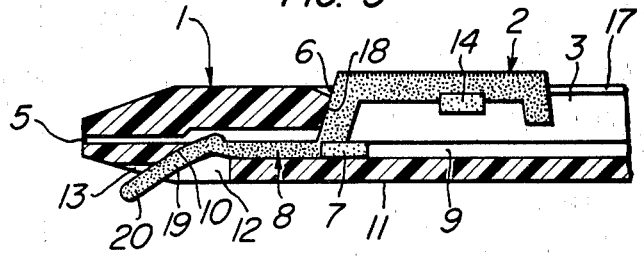
FIG. 3 is a cross-sectional view of the sheath type holder with the blade removed of the embodiment as shown in FIG. 1.
Figure 4:
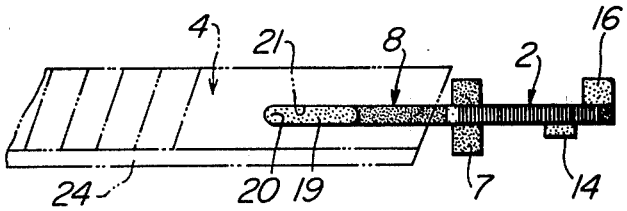
FIG. 4 is a plan view of the control knob with the blade attached thereto of the embodiment as shown in FIG. 1.

Embodiments of the present invention will be described with reference to FIGS. 1–7. The same parts of the embodiments will be designated at the same reference numerals.

FIGS. 1–4 show an embodiment of the present invention.

In the upper wall of a sheath type holder 1, a slot 3 is provided, and is extended from the front portion of the holder 1 to the rear end thereof for allowing the upper portion of a control knob 2 to be moved therealong. The holder 1 is provided with a through passage 5 therein through which a blade 4 is moved, and a slide bore 9 in the inner surface of the bottom wall thereof in which guide projections 7 extended from the lower end of an intermediate portion 6 of the control knob 2 and a retaining portion 8 of the control knob 2 forwardly extended from the guide projections 7 are slidingly moved. In the front end portion of a bottom wall 11 of the holder 1, a guide bore 12 continuing from the slide bore 9 and a guide groove 13 forwardly extended from the guide bore 12 are provided.

When the control knob 2 is moved along the slot 3, the blade 4 which is retained by the retaining portion 8 of the control knob 2 is moved in the through passage 5. The control knob 2 is provided with a fixing projection 14 which is horizontally extended from an upper portion of the control knob 2 and which is adapted to engage one of a plurality of recesses 15 provided at one side of the slot 3 to stop the control knob 2 in a desired position in the slot 3.

The control knob 2 is further provided on the upper portion thereof with a stopper projection 16 which is engaged with a stepped portion 17 of the slot 3 so as to prevent the control knob 2 from being slipped off from the slot 3. When the intermediate portion 6 is engaged with a front edge of the slot 3, a front end 20 of an elliptic projection 19 of the retaining portion 8 of the control knob 2 is moved along the slide bore 9 and introduced into the guide groove 13 via the guide bore 12 provided in the bottom wall 11 of the holder 1. At this time, the elliptic projection 19 impinges upon a front wall 10 of the slide bore 9 so that at least a part of the elliptic projection 19 remains in the through passage 5.

As the blade 4 is inserted in the through passage 5, a part of the elliptic projection 19 is engaged by an elliptic aperture 21 provided in the base portion of the blade 4, so that the blade 4 is detachably retained by the retaining portion 8 of the control knob 2.

In order to fix the blade 4 in the holder 1, the upper portion of the control knob 2 is depressed so as to disengage the fixing projection 14 from the recesses 15 to allow a forward movement of the control knob 2, so as to bring the portion 6 of the latter into engagement with a front wall 18 of the slot 3. As a result, the guide projection 7 and the retaining portion 8 are moved along the slide bore 9 and the elliptic projection 19 of the retaining portion 8 comes to impinge upon the front wall 10 of the slide bore 9. At this time, a part of the elliptic projection 19 is positioned within the through passage 5, and the fixing projection 14 is returned upwardly due to the elasticity thereof into engagement with one of the recesses 15, while the stopper projection 16 comes to the stepped portion 17 of the slot 3 thereby to fix the control knob 2 in the holder 1.

The front end 20 of the elliptic projection 19 is moved through the guide bore 12 and introduced into the guide groove 13 so as to be projected from the bottom surface of the holder 1.

When the blade 4 having the aperture 21 at the base portion thereof is inserted in the through passage 5, the aperture 21 is engaged with a part of the elliptic projection 19. As the control knob 2 is moved rearward, after depressing the same to cause disengagement of the fixing projection 14 from the recess 15, the blade 4 is moved rearward due to the mutual engagement of the elliptic aperture 21 and the elliptic projection 19. Then, as the control knob 2 is stopped and released when the desired projection length of the blade is obtained, the control knob 2 is returned upward to bring the fixing projection 14 into engagement with the recess 15, while the stopper projection 16 comes to engage the stepped portion 17, so that the blade 4 is fixed to project from the holder by the desired length. The blade 4 can be removed in the reverse manner from the holder 1 by moving the control knob 2 frontwardly.

Figure 5:
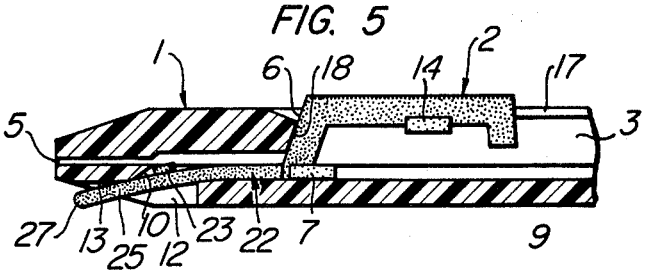
FIG. 5 is a cross-sectional view of the sheath type holder with the blade removed of another embodiment of the present invention.
Figure 6:
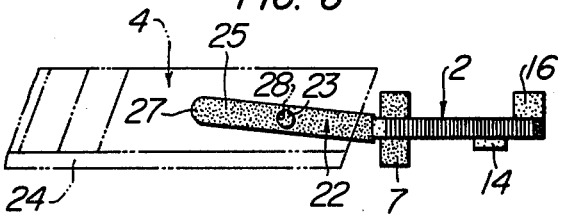
FIG. 6 is a plan view of the control knob with the blade attached thereto of the embodiment as shown in FIG. 5.
Figure 7:
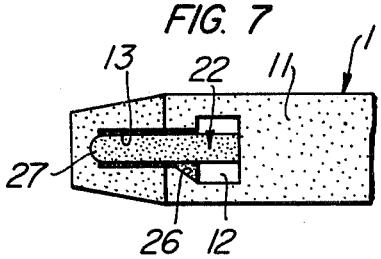
FIG. 7 is a bottom view of the front end portion of the sheath type holder of the embodiment as shown in FIG. 5 in which the front end of the stopper portion of the control knob is slided into the recess provided in the outer surface of the front end portion of the bottom wall of the holder.

FIGS. 5–7 show another embodiment of the present invention. This embodiment is identical with the above-described embodiment except that a retaining portion 22 of a control knob 2, a circular projection 23 extended therefrom and a guide groove 13 are partially different from the corresponding parts of the above-described embodiment.

In this embodiment, the retaining portion 22 of the control knob 2 has an inclined section 25 which is horizontally inclined in a direction opposite to the direction in which an edge 24 of a blade 4 is extended therefrom. Such a portion of the bottom wall 11 of the holder 1 that is between the guide bore 12 and the guide groove 13, inclined surface 26 is provided at the opposite side to the edge 24 of the blade 4.

In order to fix the blade 4 to the holder 1, the control knob 2 is depressed to disengage a fixing projection 14 from recesses 15 and is forwardly moved until the intermediate portion 6 of the control knob 2 impinges upon a front wall 18 of the slot 3. Then, the control knob 2 is upwardly moved by its own elasticity, and the fixing projection 14 is again brought into engagement with one of the recesses 15, while the stopper projection 16 engaged by the stepped portion 17 of the slot 3. Thus, the control knob 2 is fixed in the holder 1. At this time, guide projections 7 extended from the intermediate portion 6 of the control knob 2 and the retaining portion 22 of the control knob 2 are moved along the slide bore 9 and the inclined section 25 of the lower portion 22 of the control knob 2 impinges upon a front wall 10 of the slide bore 9. At the same time, a part of the circular projection 23 of the inclined section 25 is positioned within the through passage 5, and the front end 27 is moved through the guide bore 12 in a bottom wall 11 of the holder 1 and introduced into the guide groove 13 via the inclined surface 26.

As the blade 4 is inserted in the through passage 5, a part of the circular projection 23 is engaged by the circular aperture 28 provided in the base portion of the blade 4. The control knob 2 then depressed so as to disengage the fixing projection 14 from the recesses 15 and is moved rearwardly. As a result, the circular projection 23 engages the circular aperture 28 in the base portion of the blade 4 and the front end 27 of the inclined section 25 is introduced into the through passage 5 via the guide groove 13, inclined surface 26 and the guide bore 12. The blade 4 is at this time moved while being pushed toward a right edge 30 of the outlet of the through passage 5, which is at the opposite side of the edge 24 of the blade 4, with the edge 24 not contacting a left edge 29 of the outlet of the through passage 5. As the control knob 2 is stopped in a suitable position and released from the depressing force, the fixing projection 14 is upwardly moved due to its elasticity and comes to engage one of the recesses 15, and the stopper projection 16 impinges upon the stepped portion 17 of the slot 3. Thus, the blade 4 is stably fixed in the holder 1.

The blade 4 can be detached from the holder in the reverse manner by forwardly moving the control knob 2.

In this embodiment, the blade 4 can be easily fixed to and detached from the holder 1. Moreover, when the blade 4 is slidingly moved along the slide bore 9, the edge 24 of the blade 4 does not contact the left edge 29 of the outlet of the through passage 5. While the blade 4 is slidingly moved along the slide bore 9, it is pushed toward the right edge 30 of the outlet of the through passage 5 by the inclined section 25 of the retaining portion 22 of the control knob 2. Therefore, the edge 24 of the blade 4 is never damaged by the left edge 29 of the outlet of the through passage 5.

The control knob 2 in the present invention is preferably made of a plastic material. In the foregoing embodiments, the control knob 2 having blade 4 attached thereto is fixed in the holder 1, as the control knob 2 is released from the depressing force exerted thereon, so as to be upwardly moved due to its elasticity thereof so that the fixing projection 14 provided at one side of the upper portion of the control knob 2 and the stopper projection 16 provided at the other side thereof are brought into engagement with a plurality of recesses 15 provided at one side of the slot 3 and the stepped portion 17 provided at the other side thereof, respectively. However, the slot 3 may be provided with a plurality of fixing recesses at both sides thereof and the upper portion of the control knob 2 may be provided with cooperating retractable fixing projections at both sides thereof. The stopper projection 16 may be substituted by something like the guide projections 7, which are horizontally projected in the opposite directions adapted to moved within the slide bore 9. In such a modification, the control knob 2 may also be fixed in the holder 1 while moving forwardly or rearwardly along the slot 3 to allow the fixing projections to be repeatedly engaged with and disengaged from the fixing recesses. The control knob 2 may also be provided with a tightening screw to fix the same to the upper wall of the holder 1 therewith.

The present invention is not, of course, limited to the above embodiments; it may be modified in various ways within the scope of the appended claims.

What is claimed is:

1. A cutter knife comprising a sheath type holder having a front end portion with a front opening and a rear end portion, an elongated slot in said sheath having a forward contact surface nearer the front end portion than the rear end portion, a through passage extending from said front opening toward said rear end portion, a knife blade component movable in said through passage from at least a first position wherein said blade projects from said front opening to at least a second position where said blade is entirely recessed in said through passage, a control knob having an upper portion projecting from said sheath intermediate said front end portion and said rear end portion and being movable in said elongated slot, said control knob including an elongated deflectable retaining component extending from said upper portion into said through passage, one of said components being formed with an aperture and the other said component being formed with a projection engageable in said aperture to detachably join said knife blade to said control knob such that movement of said control knob in said slot causes movement of said knife blade in said through passage, said sheath further including means for deflecting said retaining component away from said knife blade component a predetermined amount when said control knob is moved in said slot against said forward contact surface, said deflecting means enabling said projection to disengage from said aperture to permit removal and replacement of said knife blade through said front opening.

2. A cutter knife as claimed in claim 1 wherein said projection is formed on said retaining component and said aperture is formed in said knife blade.

3. A cutter knife as claimed in claim 2 wherein said projection and said aperture are of corresponding elliptical shape.

4. A cutter knife as claimed in claim 1 wherein said deflecting means comprise an inclined surface extending from said through passage, said retaining component being engageable with said inclined surface to cause deflection of said retaining means away from said knife blade component as said control knob moves within a predetermined distance of said forward contact surface.

5. A cutter knife as claimed in claim 1 wherein said through passage has first and second opposite sidewalls and said knife blade has a cutting edge corresponding to said first sidewall and a non-cutting edge corresponding to said second, sidewall, said retaining means being inclined toward said second sidewall with respect to the direction of movement of said knife blade in said sheath to bias the cutting edge of said knife blade away from said first side wall and to bias the non-cutting edge of said knife blade toward said second sidewall during movement of said control knob in said elongated slot.

6. A cutter knife as claimed in claim 5 wherein said projection is formed on said retaining component and said aperture is formed in said knife blade.

7. A cutter knife as claimed in claim 6 wherein said projection and said aperture are of corresponding circular shape.

8. A cutter knife as claimed in claim 5 wherein said deflecting means comprise an inclined surface extending from said through passage, said retaining component being engageable with said inclined surface to cause deflection of said retaining means away from said knife blade component as said control knob moves within a predetermined distance of said forward contact surface.

9. A cutter knife as claimed in claim 8 wherein a sloping wall portion is provided in said sheath between said second sidewall and said inclined surface to facilitate engagement of said retaining means with said inclined surface as said control knob moves toward said forward contact surface.

10. A cutter knife as claimed in claim 4 wherein said inclined surface extends to an outside portion of said sheath and said retaining means projects from said outside portion when said control knob is moved against said forward contact surface, said retaining means being recessed in said sheath when said control knob is moved a predetermined amount away from said forward contact surface.

* * * * *